US007434621B2

(12) United States Patent
Aarvik et al.

(10) Patent No.: US 7,434,621 B2
(45) Date of Patent: Oct. 14, 2008

(54) SYSTEM AND A METHOD FOR PREDICTION AND TREATMENT OF SLUGS BEING FORMED IN A FLOW LINE OR WELLBORE TUBING

(75) Inventors: Asbjørn Aarvik, Oslo (NO); Egil Henrik Uv, Hjellestad (NO)

(73) Assignee: Norsk Hydro ASA, Oslo (NO)

( * ) Notice: Subject to any disclaimer, the term of this patent is extended or adjusted under 35 U.S.C. 154(b) by 85 days.

(21) Appl. No.: 10/538,504

(22) PCT Filed: Dec. 17, 2003

(86) PCT No.: PCT/NO03/00423

§ 371 (c)(1),
(2), (4) Date: Feb. 7, 2006

(87) PCT Pub. No.: WO2004/057153

PCT Pub. Date: Jul. 8, 2004

(65) Prior Publication Data

US 2006/0151167 A1 Jul. 13, 2006

(30) Foreign Application Priority Data

Dec. 23, 2002 (NO) ..... 20026229

(51) Int. Cl.
*E21B 43/12* (2006.01)

(52) U.S. Cl. ..... 166/267; 137/1; 137/187; 210/739

(58) Field of Classification Search ..... 166/267, 166/250.01; 137/1, 171, 173, 187, 203; 210/739, 210/170.09; 702/50
See application file for complete search history.

(56) References Cited

U.S. PATENT DOCUMENTS

| | | | | |
|---|---|---|---|---|
| 3,416,547 | A * | 12/1968 | Glenn, Jr. et al. | 137/12 |
| 5,154,078 | A | 10/1992 | Codazzi | |
| 5,256,171 | A * | 10/1993 | Payne | 95/19 |
| 5,544,672 | A | 8/1996 | Payne et al. | |
| 5,708,211 | A | 1/1998 | Jepson et al. | |
| 6,390,114 | B1 * | 5/2002 | Haandrikman et al. | 137/2 |
| 2003/0225533 | A1 * | 12/2003 | King et al. | 702/50 |
| 2004/0245182 | A1 * | 12/2004 | Appleford et al. | 210/739 |
| 2006/0041392 | A1 * | 2/2006 | Korske | 702/50 |

FOREIGN PATENT DOCUMENTS

WO 0246577 6/2002

* cited by examiner

*Primary Examiner*—Jennifer H Gay
*Assistant Examiner*—Daniel P Stephenson
(74) *Attorney, Agent, or Firm*—Wenderoth, Lind & Ponack, L.L.P.

(57) ABSTRACT

A system and a method for prediction and treatment of all kinds of slugs being formed in a flow line system or wellbore tubing transporting a multiphase fluid towards a downstream process including a separator or a slug catcher at the process inlet. The system includes a slug detector (1) located downstream of the point for slug initiation and upstream of the process and a computer unit (4) integrating the flow line system and the downstream process including software which determines the type of the slug, its volume and predicts its arrival time into the downstream process. The computer unit processes all its incoming data to obtain an optimum regulation of the process so that process perturbations due to incoming slugs are reduced to a minimum through the process.

13 Claims, 3 Drawing Sheets

SYSTEM AND A METHOD FOR PREDICTION AND TREATMENT OF SLUGS BEING FORMED IN A FLOW LINE OR WELLBORE TUBING

BACKGROUND OF THE INVENTION

1. Technical Field

The present invention relates to a method and a system for prediction and treatment of hydrodynamic and terrain-induced slugs being transported in a multi-phase flow line.

The method and the system according to the present invention can be adapted to any production system, e.g. flow line system or wellbore tubing, transporting a multiphase fluid towards a downstream process including a separator (two- or three-phase) or a slug catcher at the inlet, in which there is regulation of both pressure and liquid level(s). The multiphase fluid normally consists of a mixture of an oil (or a condensate) phase, gas and water.

2. Description of Related Art

A typical production system where the present invention could be implemented includes multiphase transport from platform wells, from subsea wells towards a subsea separator, from a subsea production template towards an offshore platform including a riser, between offshore platforms, from a subsea production system towards an onshore process facility or between onshore process facilities.

Depending on fluid properties, flow line characteristics and superficial velocities of the different fluid phases, a multiphase production system might give what is known as slug flow, experienced as fluctuating mass flow and pressure at the production system outlet. Further, if these slugs are "large" compared to the design of the downstream equipment, the fluctuations could propagate into the process and reach a level untenable to the operators. As a consequence, and as a precaution to avoid a process trip, there are numerous examples where multiphase production lines have been choked down due to incoming slugs.

Slugs are normally initiated in two ways that are fundamentally different. Terrain-induced slugs are caused by gravity effects when the velocity differences, and thus the interfacial friction, between the separate fluid phases is too small to allow the lightest fluid(s) to counteract the effect of gravity on the heavier fluid(s) in upward inclinations. Hydrodynamic slugs (identified in a flow regime envelope as a function of the pipe angle and the superficial fluid velocities for a given fluid) are formed by waves growing on the liquid surface to a height sufficient to completely fill the pipe. Because of differences in the velocities of the various fluid phases up- and downstream of this hydrodynamic slug, an accumulation of liquid and thus a dynamic slug growth can occur.

Hydrodynamic slugs too are affected by the flow line elevation profile, since their formation and growth depend on the pipe angles. Note, however, that an obvious way to prove the distinction between terrain-induced and hydrodynamic slugs is that hydrodynamic slugs could be formed in 100% horizontal flow lines (sometimes even in downwards inclination), whereas terrain-induced slugs somehow need an up-wards inclination.

Slugging is by definition a transient phenomenon, and steady state conditions are hard to achieve in a slugging flow line system. In such a system, hydrocarbon liquid (alternatively water or a hydrocarbon/water mixture) accumulates along the production system and the slugs will at some point reach the flow line exit. Between these slugs, there will be periods where small amounts of liquid exiting the system and the process will more or less receive a single gas phase, also described as gas slugs.

In order to overcome process disturbances due to slugging (terrain-induced or hydrodynamic), three methods have traditionally been used in multiphase transportation systems:

- Reduce the flow rate and thereby the slug volumes within the limits of the downstream process, by throttling the inlet choke or by selecting a smaller flow line diameter in the design phase
- Prolong start-up time or ramp up time when changing flow rates
- Increase if possible the dimensions of the downstream process (i.e. slug catcher, alternatively the 1$^{st}$ stage separator)

These "traditional" methods will either reduce production from the flow line systems in question or increase the costs and dimensions of the downstream process. Additionally, even if accounted for, slugs might grow larger than expected or could occur at unfortunate moments compared to actual process capabilities. As a consequence, the pressure and flow fluctuations could result in process shut-downs, which might have significant financial impacts.

Since every gas and oil producer wants to optimize the operating conditions of their process plants, there have been several attempts to find improved solutions to overcome process perturbations caused by slugging in the upstream production system.

U.S. Pat. No. 5,544,672 describes a system for mitigation of slug flow. It detects incoming slugs upstream of the separator and performs a rough calculation of their respective volumes. These slug volumes are thereafter compared with the liquid handling capacity of the separator. If the estimated volume of the incoming slugs exceeds the liquid slug handling capacity of the separator, a throttling valve located upstream of the separator is choked.

This solution has the advantage that it is simple and could be used for both hydrodynamic as well as terrain-induced slugs, since it is located downstream of the point where slugs are generated. However, the system entails some major disadvantages:

- Since the flow rate is being throttled down, it has a negative impact on the production and thereby the field economics.
- It does not take into account the slug handling capacity in the downstream process.
- It does not describe how gas slugs are identified and treated. As a consequence pressure fluctuations in the separator due to incoming gas slugs must still be solved by gas flaring.
- The system does not separate water slugs from hydrocarbon (HC) liquid slugs which could give process perturbations downstream of a three-phase separator.
- It prolongs the start-up time after system shut-down, since the production is being throttled down every time a liquid slug is present.

International Patent Application WO 01/34940 describes a small (mini-) separator located at the top of the riser just upstream of the 1$^{st}$ stage separator. Slugs are either suppressed by volumetric flow controller or liquid flow controller mode, depending on the slug characteristics. Regulation is achieved by two fast acting valves on the gas and liquid outlet streams downstream of the mini-separator, based on pressure and liquid level data from the mini-separator as well as flow rate measurements of its outlet streams.

Moreover, the International Patent Application WO 02/46577 describes a model-based feedback control system for stabilization of slug flow in multiphase flow lines and risers. The system consists of a single fast acting valve located at the outlet of the transport system, i.e. upstream of the separator. The opening of this valve is adjusted by a single output control signal from the feedback controller that uses continuous monitoring of pressure upstream of the point where slugs are generated as the main input parameter. This control system is specially suited for terrain-induced slugs since any liquid accumulation is detected by pressure increase upstream of the slug (due to static pressure across the liquid column). However, the system does not show the same performance for slugs which are hydrodynamic by nature since these slugs could be formed in perfectly horizontal flow lines, and thereby not cause a build-up of pressure upstream of the slug.

Briefly, for the two latter slug control systems, fast acting equipment located at the outlet of the transportation system, in combination with quick response time of the control loops are used to suppress development of slugs, by immediately counteracting the forces contributing to slug growth.

However, these solutions also entail several disadvantages:

- As for the slug mitigation system they do not take into account the slug handling capacity in the downstream process.
- The control system described in WO 02/46577 does not cater to hydro-dynamic slugs, while the system described in WO 01/34940 handles slugs which are terrain-induced by nature far better than hydrodynamic slugs.
- They are normally not self-regulating for any operational range in the transport system, and the systems require manual input from an operator or must be de-activated during some of the normal production scenarios.
- They both require fast acting valve(s) in combination with quick response time of the control loops.
- They generalize on flow line systems including vertical piping (i.e. risers or tubing) at the outlet of the transport system.
- The system described in WO 01/34940 requires topside equipment and could be costly, especially in the case of weight being an issue.

Generally speaking, none of the existing systems fully integrates the transport system and the downstream process. Hence, they do not cover the full range of incoming slugs including hydrodynamic slugs as well as gas and water slugs. Finally, their application is limited to a narrow operating range and they require manual input or de-activation at some time.

SUMMARY OF THE INVENTION

In light of the shortcomings mentioned above, the inventors have found that there is a need for a more efficient method and system for prediction and treatment of slugs. The present invention describes a method and a system applicable in connection with a downstream process in which the disadvantages of former systems have been eliminated. The basic idea is to fully integrate the production system and the downstream process. The main advantages of the invention is that it utilizes the whole downstream process for slug treatment and it applies to any kind of slug normally present in a multiphase flow line system independent of the type or nature of the slug. It will also cover any operating range if it is properly designed.

In accordance with the present invention, this objective is accomplished in a method of the above kind in that said method comprises the following steps: detecting said slug downstream of the point for slug initiation and upstream of said process by means of a slug detector, determining and measuring all main characteristics of said slug by means of a computer unit that receives all signals from said slug detector. The computer unit receives signals from all instruments needed for regulation of pressure and liquid levels from every separator or slug catcher in the liquid trains of the entire downstream process. The computer unit determines the nature of every incoming slug and predicts its arrival time to said separator or slug catcher and corresponding volume and compares it with the actual slug handling capability of said process. The computer unit processes all of the incoming data in order to find an optimum regulation of said downstream process so that process perturbations due to incoming slugs are reduced to a minimum throughout the entire process. The regulation of said process is achieved by means of choke adjustments or by adjusting the speed of compressors or pumps connected to each separator.

Furthermore, in accordance with the present invention, this objective is accomplished in a system of the above kind in that the system comprises a slug detector located downstream of the point for slug initiation and upstream of said process inlet including instruments dedicated to determine and measure the main slug characteristics of every incoming slug, a computer unit integrated into said flow line system and said downstream process including software which determines the type of the slug, its volume and predicts its arrival time into said downstream process.

BRIEF DESCRIPTION OF THE DRAWINGS

The present invention will be described in further detail in connection with the following figures, where.

DETAILED DESCRIPTION OF THE INVENTION

Figure 1:
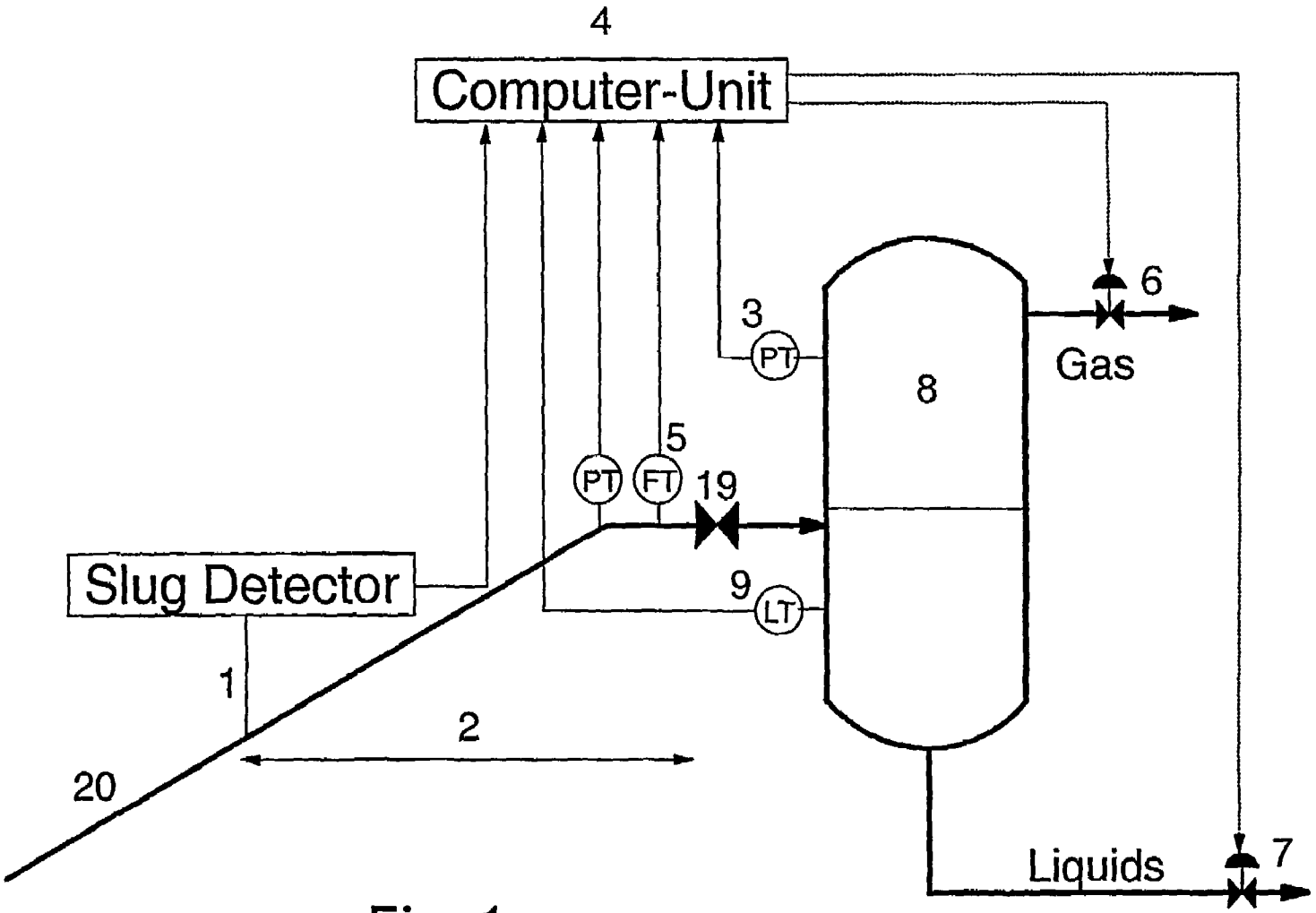
FIG. 1 shows a process diagram of the present invention in its simplest form implemented in an offshore production system producing towards an onshore process including a vertical two-phase slug catcher at the inlet of the process.

FIG. 1 shows a process diagram of the present invention in its simplest form implemented in an offshore production system producing towards an onshore process including a vertical two-phase slug catcher 8 at the inlet of the process. It is further seen that the slug catcher pressure 3 is controlled by adjustment of a gas outlet valve 6. Correspondingly, its liquid level 9 is controlled by adjustment of a liquid outlet valve 7.

A simple description of the invention is as follows: The distance 2 between the slug detector 1 and the process has been optimized with respect to the process and its parameters for regulation. When the slug detector 1 detects a liquid slug, the computer unit 4 determines its nature and calculates its arrival time and volume. Based on this information and the current liquid level 9 in slug catcher 8, the computer unit immediately sends a signal to the liquid valve 7 to start liquid draining of the slug catcher 8, prior to slug arrival. When the liquid slug finally arrives at the slug catcher, the liquid level will already be adjusted to near low alarm, and the liquid outlet valve 7 will be nearly fully opened. Moreover, when the slug tail is detected, the liquid valve 7 starts closing before the slug tail enters the separator. Correspondingly, when a gas slug is detected, measures are taken to reduce slug catcher pressure 3 by opening the gas outlet valve 6. Thus, the forces that contribute to slug growth will be counteracted and at the same time the process will take care of the incoming slug. Hence, the invention optimizes the slug handling capacity of the process, and the operator will see reduced perturbations in the process. Depending on which option is used for determination of the fluid velocities, a multiphase meter or flow transmitter 5 is included upstream of the topside choke 19.

Figure 2:
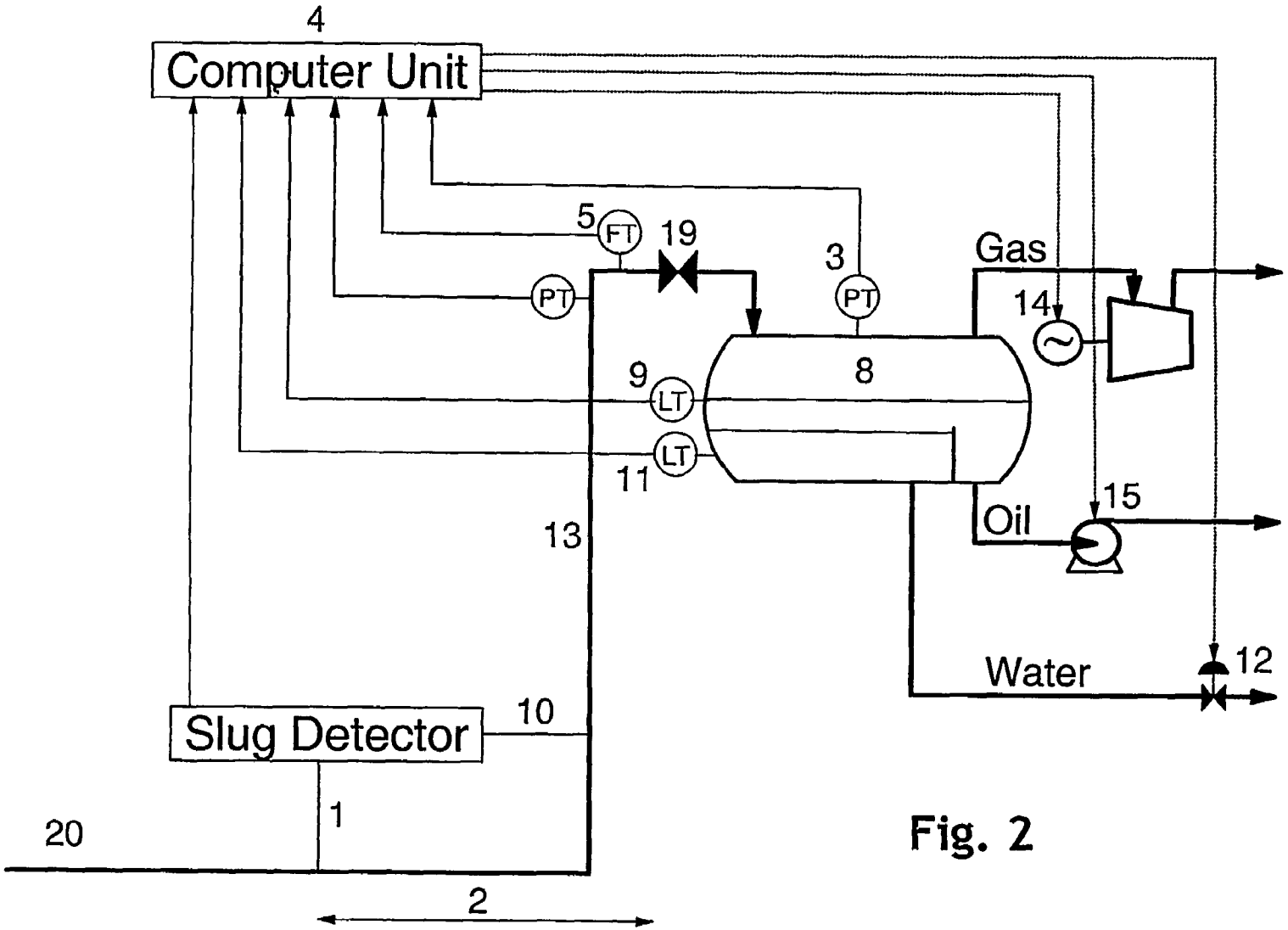
FIG. 2 shows a simplified process diagram of the present invention implemented in an offshore production system including a riser producing towards a horizontal three-phase separator.

FIG. 2 shows a simplified process diagram of the present invention implemented in an offshore production system including a riser 13, producing towards a horizontal three-phase separator 8, not including the hydrocarbon liquid train downstream of the separator. As in FIG. 1 the distance 2 between the slug detector 1 and the process has been optimized with respect to the process and its parameters for regulation. An alternative location 10 of the slug detector as part of the riser is also indicated for deep-water developments. In this example it is seen that the separator pressure 3 is regulated by adjustments of the gas compressor speed 14. Moreover, the hydrocarbon liquid level 9 is regulated by speed control of the downstream pump 15. Regulation of the water level 11 is achieved by means of an outlet valve 12. Basically, the regulation of the system is performed very similar to the example given in FIG. 1, but instead of using outlet valves for regulation of the pressure 3 and liquid level 9, the computer unit 4 gives input to the gas compressor 14 and oil pump 15 speed controls, respectively. In this production system, water slugs are detected because they are denser than oil/condensate slugs besides having a lower content of gas. Depending on which option is used for determination of the fluid velocities, a multiphase meter or flow transmitter 5 is included upstream of the topside choke 19.

Figure 3:
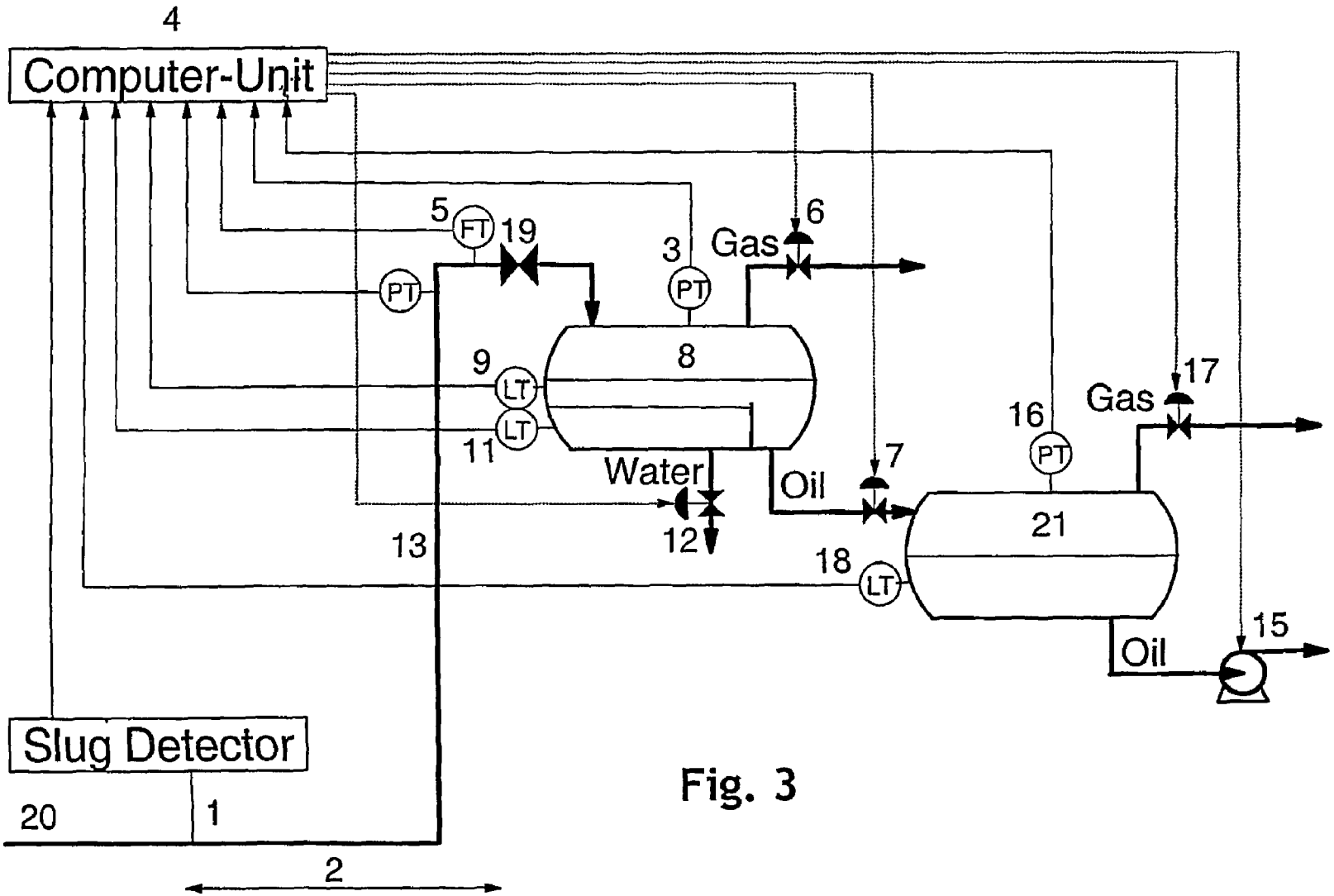
FIG. 3 shows a simplified process diagram of the present invention implemented in an offshore production system including a riser and a horizontal three-phase separator at the process inlet.

FIG. 3 shows a simplified process diagram of the present invention implemented in an offshore production system including a riser 13 and a horizontal three-phase separator 8 at the process inlet. As opposed to the first two figures, the downstream liquid train is included, and it includes a second separator 21 in addition to the first separator 8. It is seen that the computer unit 4 is used for regulation of pressure and liquid level in the entire hydrocarbon liquid train, and hence the entire process takes part in the slug treatment. The separator pressures 3 and 16 are both regulated by means of valves on the gas outlets 6 and 17. The liquid levels 9 and 18 are controlled by means of a valve on the liquid outlet 7 of the first separator 8 and a pump 15 on the liquid outlet of the second separator 9. Regulation of the water level 11 is achieved by means of an outlet valve 12. As in the other two figures, the distance 2 between the slug detector 1 and the process has been optimized with respect to the process and its parameters for regulation.

Depending on which option is used for determination of the fluid velocities, a multiphase meter or flow transmitter 5 is included upstream of the topside choke 19.

It is important that the computer unit 4 also includes normal (traditional) pressure and level regulation of each separator unit in the process in case the pressure or liquid level(s) pass their alarm levels, approaching their trip levels. During such circumstances, there might be a need to de-activate the regulation.

When utilizing the present invention the incoming slugs (terrain-induced or hydro-dynamic by nature) are detected at an early stage by instrumentation (slug detector 1) dedicated to define the slug characteristics. While e.g. WO 02/46577 bases its control on measurements of pressure and temperature upstream of the point where slugs are generated (in order to suppress slug formation if any pressure build-up is recorded), it is essential for the present invention that the instrumentation is located downstream of the point of slug formation, since its intention is to describe the slug characteristics. The simplest way to define the slug characteristics is by use of a densitometer as described in U.S. Pat. No. 5,544,672, but the instrumentation could easily be extended for more sophisticated information. Online information of the fluid mixture density is used for determination of:

Liquid slug front

Liquid slug tail

Nature of slug:

- A very high density gives indication of a water slug.
- A high density gives indication of a HC liquid slug.
- A low density gives indication of a gas slug.

In addition to a densitometer, the basic instrumentation according to the present invention includes registration of the differential pressure (dP) between the slug detector and the process arrival as a precaution if slugs should be formed downstream of the slug detector. Including more complex instrumentation will further optimize the detector, as long as the production system remains pigable. In particular, additional information on the on-line water cut in combination with the local hold-up or void fraction as well as fluid velocities of the different phases would be valuable input to the computer unit 4, and so is a multiphase meter 5 at the flow line outlet.

The location 2 of the slug detector must be sufficient for the downstream process to respond adequately prior to slug arrival. Hence, this location 2 needs to be optimized for every new implementation, since it very much depends on the actual production system. It is believed that an optimum location will be within 3 km from the process inlet, giving the computer unit sufficient time to react to incoming slugs. One exception applies to large gas, condensate systems producing towards an onshore installation where the volume of the slug catchers sometimes is very significant. Note also that for extreme deep-water developments, the optimum location could be somewhere inside the riser itself as seen in FIG. 2 (at 10) and not necessarily in the subsea flow line or at the riser bottom.

In short, the basic principle of the present slug detector is quite similar to the one described in U.S. Pat. No. 5,544,672. The main improvements are as follows:

- In order to optimize the performance of the computer unit, the location of the slug detector must be adapted to the slug handling capabilities of the downstream process.
- The detector must make the distinction between hydrocarbon liquid slugs and water slugs.
- Therefore, in addition to the densitometer, the slug detector includes a measurement of one of the following parameters: Gas void fraction, local liquid hold-up or water cut.

The slug detector sends its signals to the computer unit 4, which constitutes the main component of the present invention. It collects all incoming information from the slug detector as well as the main process parameters of the downstream liquid train. Its overall purpose is to calculate (for every incoming slug):

a) The estimated arrival time for the incoming slug.

b) The slug volume.

c) The nature of the slug (i.e. water slug, hydrocarbon liquid slug or gas slug) and thereafter optimize the regulation of the downstream process.

The computer unit, which preferably includes an on-line transient thermohydraulic simulator, includes three options to define the fluid velocity(ies) and thereby the estimated slug arrival time. Firstly, it could be estimated by manual input, but then some operating scenarios would require de-activation of the system and thereby use of traditional (i.e. manual) methods for slug control. The second alternative is to calculate the fluid velocity(ies) by use of the thermohydraulic flow simulator, where a multiphase meter at the flow line outlet 5 will improve the performance of the computer calculations. Finally, the velocities of the different fluid phases could be determined based on on-line ultrasonic measurements, located somewhere between the slug detector and the process arrival.

The prediction of reliable slug volumes is obtained through an integral module. Based on information of the slug front, slug tail, mixture density, the fluid velocities defined above and one of the following: water cut, gas void fraction or local hold-up, the computer unit will give accurate estimates of the slug arrival times and their corresponding volumes.

When all of the slug characteristics have been described, the output signals from the computer unit will be optimized and adjusted to reduce the process perturbations in the downstream HC liquid train to a minimum.

The present invention describes a solution for slug treatment that has a number of advantages compared to already known solutions:

Since the main slug characteristics of all incoming slugs are known before they enter downstream equipment, it is easy to take corrective measures to reduce fluctuations and perturbations in the entire process.

It applies to any type of slug independent of whether it is hydrodynamic by nature or terrain-induced and regardless of whether it is a liquid, water or a gas slug.

It links the transport system and the downstream process and thereby makes use of all the slug handling capacity in the entire downstream process.

It applies to any production system of multiphase transport, regardless of whether it is a well or if it is a subsea, topside or onshore installation.

Basically, a single computer unit is sufficient for control of a production facility receiving incoming slug flow from different sources.

It will shorten the start-up time after shut-down or for variations of flow rate.

There is no need for fast acting valves.

If properly designed it will reduce the risk of process shutdowns due to slug flow.

The invention claimed is:

1. A system for prediction and treatment of all kinds of slugs formed in a flow line transporting a multiphase fluid towards a downstream process including at least one separator or slug catcher at an inlet of said downstream process, wherein said system comprises:

a slug detector for detecting any incoming slug, said slug detector being located between a point of slug initiation and the inlet of said downstream process, wherein said slug detector comprises instruments in said flow line for measuring flowing pressure, fluid mixture density and at least one of gas void fraction, water cut and local liquid hold-up;

an inlet choke positioned in said flow line;

a multiphase flow meter or a fluid velocity meter located upstream of said inlet choke;

a computer unit, connected to said slug detector and either of said multiphase flow meter or said fluid velocity meter, said computer unit including software, which based on signals from said slug detector in combination with signals from either said multiphase flow meter or said fluid velocity meter, is capable of determining the nature of the detected slug and estimating its volume and its arrival time to said downstream process;

instruments connected to said computer unit for continuously monitoring pressure and liquid levels in said separator or said slug catcher; and at least one device, connected to said separator or said slug catcher, for receiving signals from said computer unit and regulating the pressure and/or liquid level in said separator or said slug catcher so that process perturbations due to incoming slugs are reduced to a minimum through said downstream process.

2. A system according to claim 1, wherein said instruments comprise at least one liquid level transmitter and/or at least one pressure transmitter mounted to said separator or said slug catcher.

3. A system according to claim 1, wherein said device comprises at least one valve and/or at least one compressor and/or at least one pump.

4. A system according to claim 1, wherein the distance from the slug detector to the downstream process equipment is for every new implementation optimized with respect to slug treatment capabilities of said process and the parameter settings of all regulating devices being controlled by said computer unit.

5. A system according to claim 1, wherein the location for said slug detector is in said flow line a specified distance upstream of said downstream process.

6. A system according to claim 1, wherein the computer unit integrates said flow line system and said downstream process by adjusting the pressure and liquid level regulating devices based on received slug information.

7. A system for prediction and treatment of all kinds of slugs formed in a flow line transporting a multiphase fluid towards a downstream process including at least one separator or slug catcher at an inlet of said downstream process, wherein said system comprises:

a slug detector for detecting any incoming slug, said slug detector being located between a point of slug initiation and the inlet of said downstream process, an inlet choke positioned in said flow line;

a multiphase flow meter or a fluid velocity meter located upstream of said inlet choke;

a computer unit, connected to said slug detector and either of said multiphase flow meter or said fluid velocity meter, said computer unit including software, which based on signals from said slug detector in combination with signals from either said multiphase flow meter or said fluid velocity meter, is capable of determining the nature of the detected slug and estimating its volume and its arrival time to said downstream process;

instruments connected to said computer unit for continuously monitoring pressure and liquid levels in said separator or said slug catcher; and at least one device, connected to said separator or said slug catcher, for receiving signals from said computer unit and regulating the pressure and/or liquid level in said separator or said slug catcher so that process perturbations due to incoming slugs are reduced to a minimum through said downstream process, wherein the computer unit includes the following options for defining the fluid velocities: (1) by manual input; (2) by on-line registration using a clamp-on fluid velocity meter; or (3) by including an on-line transient simulator in combination with a multiphase meter at the flow line outlet.

8. A system for prediction and treatment of all kinds of slugs formed in a flow line transporting a multiphase fluid towards a downstream process including at least one separator or slug catcher at an inlet of said downstream process, wherein said system comprises:

a slug detector for detecting any incoming slug, said slug detector being located between a point of slug initiation and the inlet of said downstream process;

an inlet choke positioned in said flow line;

a multiphase flow meter or a fluid velocity meter located upstream of said inlet choke;

a computer unit, connected to said slug detector and either of said multiphase flow meter or said fluid velocity meter, said computer unit including software, which based on signals from said slug detector in combination with signals from either said multiphase flow meter or said fluid velocity meter, is capable of determining the nature of the detected slug and estimating its volume and its arrival time to said downstream process;

instruments connected to said computer unit for continuously monitoring pressure and liquid levels in said separator or said slug catcher; and at least one device, connected to said separator or said slug catcher, for receiving signals from said computer unit and regulating the pressure and/or liquid level in said separator or said slug catcher so that process perturbations due to incoming slugs are reduced to a minimum through said downstream process;

wherein the computer unit comprises override functions that override or suppress the slug control regulation of the downstream process if trip levels of the separators are approached.

9. A method for prediction and treatment of all kinds of slugs being formed in a flow line transporting a multiphase fluid towards a downstream process that includes at least one separator or slug catcher at an inlet of said downstream process, wherein said method comprises:

detecting said slug between a point for slug initiation in said flow line and said downstream process inlet by means of a slug detector, the nature of said slug being determined by means of a computer unit continuously receiving signals from said slug detector in combination with either a fluid velocity meter or a multiphase flow meter located upstream of an inlet choke in said downstream process, wherein said slug detector continuously records flowing pressure, fluid mixture density and at least one of gas void fraction, water cut and local liquid hold-up;

estimating the volume of said slug and its arrival time to said downstream process by said computer unit;

regulating pressures and liquid levels in said separator or slug catcher by means of instruments mounted to said separator or slug catcher; and sending signals from said computer unit to at least one device that is connected to said separator or slug catcher to regulate the pressure and/or liquid level in said separator or slug catcher so that process perturbations due to incoming slugs are reduced to a minimum through said downstream process.

10. A method according to claim 9, wherein said pressures and/or liquid levels are regulated by means of at least one valve and/or at least one compressor and/or at least one pump connected to said separator or slug catcher.

11. A method according to claim 9, wherein said pressure regulation is achieved by adjusting a choke opening of at least one gas outlet valve or by adjusting the speed of a downstream compressor.

12. A method according to claim 9, wherein said liquid level regulation is achieved by adjusting a choke opening of at least one liquid outlet valve or by adjusting the speed of a downstream pump.

13. A method according to claim 9, wherein the flow rate in said flow line is adjusted by means of said inlet choke.

* * * * *